US006983746B2

(12) United States Patent
Morgan et al.

(10) Patent No.: US 6,983,746 B2
(45) Date of Patent: Jan. 10, 2006

(54) UNDERWATER EXHAUST SYSTEM

(75) Inventors: William B. Morgan, Santa Barbara, CA (US); Connie L. Morgan, Santa Barbara, CA (US); Trent M. Schultz, Goleta, CA (US); Peter M. Ryan, Orcutt, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 0 days.

(21) Appl. No.: 10/830,823

(22) Filed: Apr. 22, 2004

(65) Prior Publication Data

US 2005/0235989 A1 Oct. 27, 2005

(51) Int. Cl.

| | |
|---|---|
| ***A62B 18/10*** | (2006.01) |
| ***A62B 18/08*** | (2006.01) |
| ***A62B 7/04*** | (2006.01) |
| ***B63C 11/02*** | (2006.01) |
| ***B63C 7/04*** | (2006.01) |

(52) U.S. Cl. ..... 128/201.27; 128/204.26; 128/201.11; 128/201.12; 128/201.15; 128/201.28; 128/204.27; 128/205.24; 128/206.29; 128/201.26; 405/186; 405/187

(58) Field of Classification Search ..... 128/204.26, 128/201.27, 201.11, 201.12, 201.15, 201.28, 128/204.27, 205.24, 206.29, 201.26; 405/186, 405/187

See application file for complete search history.

(56) References Cited

U.S. PATENT DOCUMENTS

| | | | | |
|---|---|---|---|---|
| 3,101,732 | A * | 8/1963 | Dalla Valle | 128/204.26 |
| 4,467,797 | A * | 8/1984 | Franke | 128/204.26 |
| 4,655,212 | A * | 4/1987 | Delphia | 128/201.11 |
| 4,872,453 | A * | 10/1989 | Christianson | 128/201.11 |
| 4,877,022 | A * | 10/1989 | Christianson | 128/201.11 |
| 4,884,564 | A * | 12/1989 | Lamont | 128/201.11 |
| 5,251,618 | A * | 10/1993 | Christianson | 128/205.24 |
| 5,657,746 | A * | 8/1997 | Christianson | 128/201.11 |
| 5,868,129 | A * | 2/1999 | Christianson | 128/201.11 |
| 6,119,685 | A * | 9/2000 | Kawashima et al. | 128/201.11 |
| 6,129,081 | A * | 10/2000 | Wu | 128/201.11 |
| 6,516,797 | B2 * | 2/2003 | Chen-Lieh | 128/201.11 |

* cited by examiner

*Primary Examiner*—Henry Bennett
*Assistant Examiner*—Nihir Patel
(74) *Attorney, Agent, or Firm*—Cislo & Thomas LLP

(57) ABSTRACT

Provided are exemplary embodiments of an underwater breathing exhaust system configured to lower the exhalation, effort and to direct water adjacent an exhaust valve to reduce the likelihood of water entering the system and/or gas free flowing from the system.

17 Claims, 8 Drawing Sheets

UNDERWATER EXHAUST SYSTEM

BACKGROUND

There may be many examples of underwater devices that have exhaust systems that expel the exhausting air or mixed gasses into the surrounding water during their normal functions. One example of this is the Second Stage Regulator that SCUBA divers use while diving.

Some SCUBA diving setups may include a tank of compressed air or mixed gasses that is worn by the diver, a first stage regulator attached to the tank that reduces the compressed air pressure form 3000 psi to around 150 psi, a hose that connects the first and second stage regulators, and a second stage regulator that is held in the diver's mouth that may reduce the pressure from 150 psi to ambient pressure and supply it to the diver upon demand. Some of the components of the SCUBA second stage regulator may include: the regulator housing, a flexible diaphragm that collapses inwardly during the inhalation cycle against a small lever that activates an inhalation valve, thereby supplying the diver with air, an exhaust valve used as a one way valve to allow the exhausting air or gasses to escape the regulator housing during the exhalation cycle, a bubble deflector to guide the exhausting bubbles out of the way of the diver's vision, and a mouth piece to seal out the surrounding water and to hold the regulator assembly in the diver's mouth.

The exhausting air or gasses that are exiting the SCUBA second stage regulator may travel through an opening in the wall of the regulator housing. An exhaust valve may be mounted on the outside covering this opening, and may be used as a one-way valve to control the direction of flow of the exhausting gasses. The circular opening may have one or more cross bars that go from one side of the opening to the other to be used as a mounting area for the exhaust valve and to help prevent the exhaust valve from collapsing inwardly when there is a negative pressure experienced.

Exhaust valves may be made from a molded flexible rubber or silicone and may be usually in round disk or mushroom-type shape. They may be designed to flex or peel away under pressure to open and close. The purpose of the exhaust valve may be to control the direction of flow of the exhausting gasses and to keep the surrounding water out of the regulator once the flow of gasses has stopped.

Many of the SCUBA second stage regulators exhaust directly into the surrounding water. This may mean that the water is in direct contact with the entire outside surface of the exhaust valve. Most of the second stage regulators may also have the exhaust valve(s) mounted at an angle an in the low point within the regulator housing. This may help to collect any water that has entered the regulator at or near the bottom of the system so that it can be cleared or purged out.

There may be a few reasons that exhaust valves can seep or leak water back into the regulator. One may be underpressure created during the inhalation cycle. This underpressure may flex the exhaust valve inward, distorting it against the edge of a circular opening and cross bars, causing it to leak. Another may be a passing flow of water that may catch on the outside sealing edge of the exhaust valve, flexing it open causing it to leak.

There are several reasons for water flow on the outside of the exhaust valve. One may be when the diver enters the water. Most divers enter the water somewhat rapidly, either jumping or sliding into the water. The water may very quickly flood in to the open areas of the bubble deflector. Furthermore, the water may rush in against the outside surfaces of the exhaust valve. The water may catch the edge of the valve and flex it, causing it to leak.

Another reason for water flowing past the exhaust valve may be a laminar flow of water that is created by the exhausting bubbles. Once the exhausting gasses travel through the circular opening and past the exhaust valve they may become or create bubbles. Bubbles are naturally buoyant and travel upward toward the surface. As the bubbles are traveling upward they may effect the surrounding water that is in contact with bubbles, drawing the water upward along with them creating a laminar flow of water that may flow on and past the exterior surfaces of the exhaust valve.

Exhaust valves may have been designed to provide low exhaust resistance during heavy breathing rates. This may have resulted in the valves becoming somewhat larger (1"–1.5" in diameter) or having multiple or several valves. When the diver is breathing at a lower or moderate rate, only the upper portion of the exhaust valve may be used, while the lower portion may remain in the closed position. The laminar flow of water created by the bubbles exiting the top portion of the valve may catch on the lower sealing edge of the exhaust valve causing it to leak.

Seepage or leaking of water via the exhaust valve may be a nuisance at best, and a dangerous situation if diving in contaminated or polluted water.

Another common feature of most of the SCUBA second stage regulators may be a bubble deflector. The bubble deflector may be made of some type of molded rubber or plastic and may be mounted around or next to the exhaust valve(s). The purpose of the bubble deflector may be to capture the exhausting bubbles and divert them away from the front of the diver's face and vision.

Bubble deflectors may include bubble exit openings that may be large enough to allow water to enter the lower half of the bubble exit opening, while the bubbles escape out of the top half of the bubble exit opening. This water entering at the lower half of the bubble exit opening may be part of the laminar flow of water that the bubbles create.

What is needed is a configuration that may reduce the likelihood of water entering the system and of being able to catch the exhaust valve sealing edges, causing them to leak, and a system that introduces a laminar flow of water across the exhaust valve that may reduce the likelihood of gas free flowing from the system. Furthermore, a pocket of trapped air may be created that lowers the resistance of operating the exhaust valve.

SUMMARY

Provided are exemplary embodiments of an underwater gas exhaust system configured to direct water adjacent an exhaust valve to reduce the likelihood of water entering the system and/or gas free flowing from the system.

DETAILED DESCRIPTION

Figure 1:
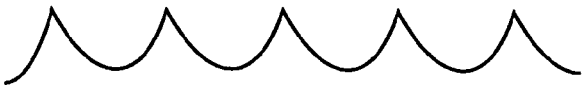
Fig. 1 Prior Art
FIG. 1 is a plan view of a prior art air exhaust system.
Figure 1:
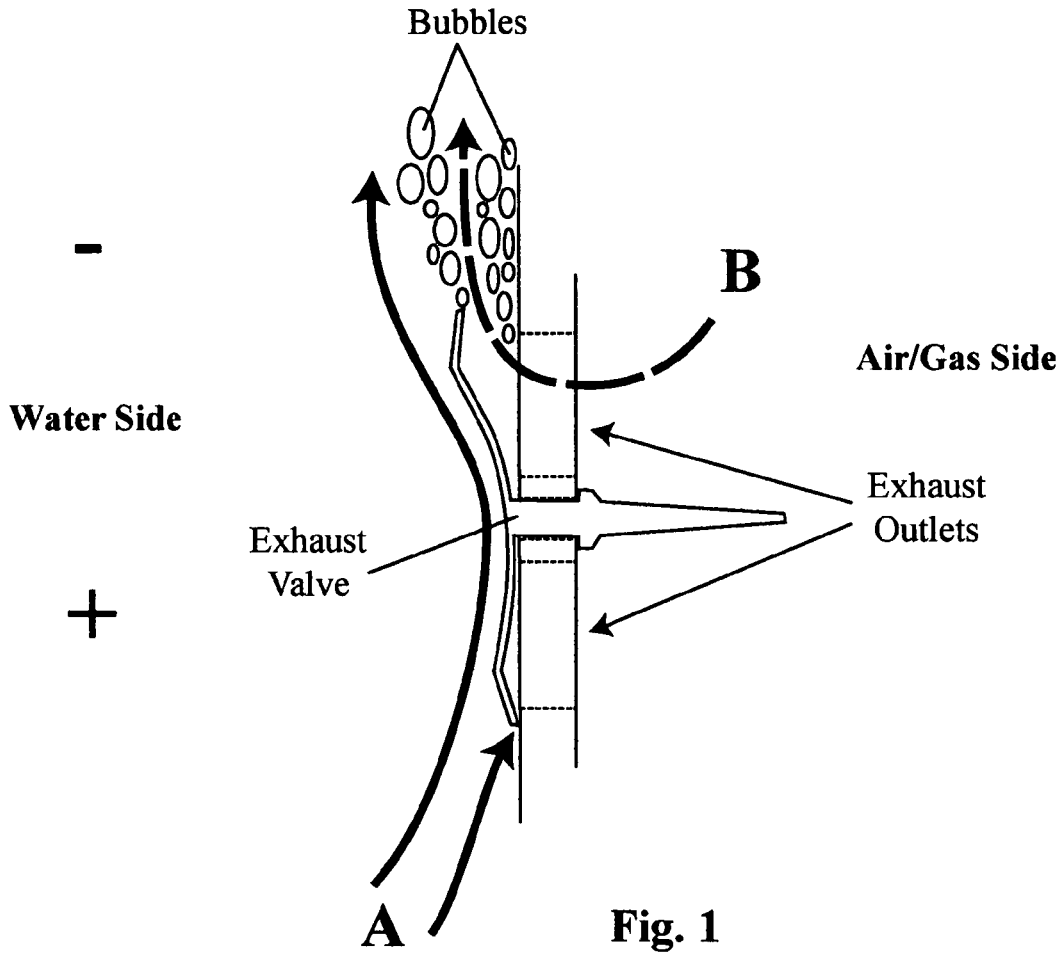
Fig. 1 Prior Art

The detailed description set forth below in connection with the appended drawings is intended as a description of exemplary embodiments and is not intended to represent the only forms in which embodiments may be constructed and/or utilized. The description sets forth the functions and the sequence of steps for constructing and operating embodiments. However, it is to be understood that the same or equivalent functions and sequences may be accomplished by different embodiments that are also intended to be encompassed within the spirit and scope of the embodiments disclosed herein.

Exemplary embodiments disclosed herein are directed to an underwater air/mixed gas exhaust system that may be installed or designed into a diving regulator that lowers the exhaust resistance by creating an air space on the outside/water side of the exhaust valve(s) for at least the upper portion of the exhaust valve(s) to operate within during the most commonly used positions and provides exhaust valve(s) with sealing edge protection and a laminar flow of water across the outside of the exhaust valve when needed to avoid a siphon or free flow condition.

One of the exemplary embodiments is in the form of a bubble deflector that can be installed onto a SCUBA second stage regulator. This bubble deflector may be manufactured and installed in a manner where it may capture part of the exhausting air or gasses in a hood or valve cover. The hood or valve cover may allow an upside down cup type of air space to form within the bubble deflector, and may create an air space for at least the top portion of the exhaust valve to operate within during the most commonly used positions by the diver (looking forward or downward at around 30°–45° angle).

To prevent any type of a free flow condition created by the exhausting gasses (bubbles) traveling through the bubble deflector, a water inlet may be configured in the bubble deflector directly below and next to the bottom of the exhaust valve. This water inlet passage may allow water to flow inward and up from the bottom of the bubble deflector, and may create a laminar flow of water that goes past the exhaust valve to combine with the exiting gasses or bubbles traveling through and out of the bubble exit openings in the bubble deflector. The continuous supply of water in the form of a laminar flow that travels past the exhaust valve may prevent a siphoning effect on the exhausting gasses/bubbles, which may cause a free flow condition in the regulator.

According to exemplary embodiments the water inlet passage may be located at a lower point in the bubble deflector than the edge or lip of the hood that may be used to create the air space for the exhaust valve to operate in. Having the water inlet passage located below the lip of the hood and directly next to the bottom of the exhaust valve may prevent any type of siphon effect on the exhausting gasses, and may allow the bubbles and water to travel upward together in a desired direction within the bubble deflector.

The water inlet may allow the ingress of water into the bubble deflector during normal use in the most common positions. Furthermore, the water inlet may also be advantageous during less common positions, such as upside down or in a face up. In those positions, the bubbles may naturally flow through, and out, the water inlet passage because the water inlet passage has become the highest exit point within the bubble deflector. Having the water and bubbles being able to reverse flow through the water inlet passage in these positions may keep the exhaust resistance in these positions to a minimum.

Other exemplary embodiments may include an exhaust valve sealing edge protector. The protector may protect the sealing edges of the exhaust valve from being caught by the laminar flow of water traveling past the outside surfaces of the exhaust valve, causing it to leak. This protector may be an integral part of the bubble deflector or regulator housing, and may be in the form of a stepped/recessed exhaust valve seating area or a protector ring that is around, and slightly larger in diameter and taller, than the outer sealing edge of the exhaust valve(s).

Yet another exemplary embodiment may include an exhaust valve cover. This valve cover may be mounted in an airtight fashion around the exhaust valve, and may create the air space for the exhaust valve to operate in. This valve cover may have two holes, an exhaust gas exit opening, and a water inlet passage.

The exhaust gas exit opening may be located at a low point of the cover to create the air space for the exhaust valve to operate in. The size of the exhaust gas exit opening may be a larger surface area than that of the surface area of the circular opening (exhaust) in the regulator housing. This may guarantee that the flow of exhausting gasses passing through the exhaust gas opening in the cover will not be constricted in any way. The water inlet passage in the cover may be located below, and directly next to, the bottom of the exhaust valve. This passage may be configured to allow water to flow inward and through the cover to prevent any siphon effect on the exhausting gasses, and causing a free flow condition.

If a bubble deflector is used with the valve cover embodiment, there may be a water inlet passage in the bottom of the bubble deflector located below and directly next to the bottom of the exhaust gas opening of the valve cover. This water inlet may prevent any type of siphoning effect on the exhausting gasses traveling through the bubble deflector.

FIG. 1 may show a gas exhaust system for a SCUBA apparatus. An exhaust valve covers the opening where gas exits the system. The exhaust valve may be circular and the path the exhaust takes is shown by the directional arrow B. Water external to the system travels in the direction of the directional arrows A. When gas exhausts out of the system it will do so at the top (or where pressure is the lowest) as shown by the minus sign. The water will travel upward with the bubbles to create a laminar flow of water across the exterior of the exhaust valve. This laminar flow of water may catch on the lower sealing edge of the exhaust valve causing it to leak. Furthermore, water may enter the system through the bottom of the exhaust valve due to the flow created.

Figure 2:
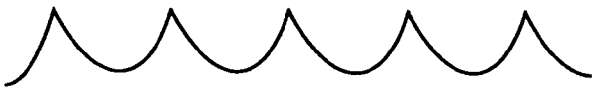
FIG. 2 is a plan view of an air exhaust system according to an exemplary embodiment.
Figure 2:
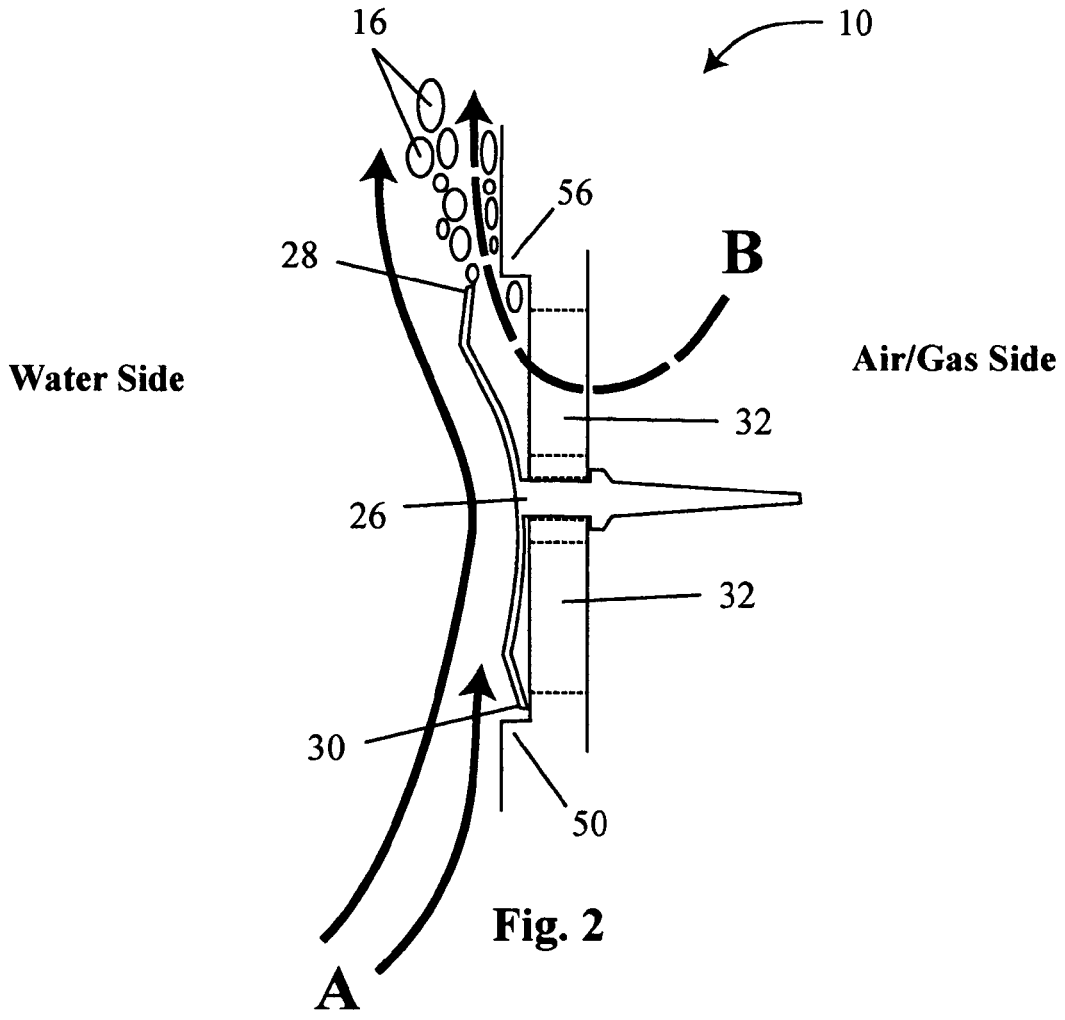

FIG. 2 shows an embodiment of a SCUBA system according to an exemplary embodiment, generally at 10. System 10 may include an exhaust valve 26 and exhaust outlets 32. Furthermore, exhaust valve 26 may have an upper sealing edge 28 and a lower sealing edge 30 since the valve is typically circular, there will typically be an upper and lower sealing edge. It will be appreciated that other configurations may be utilized including, but not limited to, a configuration with either an upper sealing edge and/or a lower sealing edge, as desired. Gas may be forced out of the system by pressure as shown by arrow B. This may cause the water to flow in the direction shown by arrow A. Gas may exit the system as bubbles 16.

System 10 may also include a projection 50 that directs the flow of the water away from the lower sealing edge 30 of exhaust valve 26. In this manner, the water flow may be directed about the exhaust valve 26 such that it may be less likely that water will enter the system, either via lower sealing edge 30 or other portion of exhaust valve 26. Furthermore, being circular, the projection surrounds the edge of the valve as shown at 56. The projection 50 may make it less likely that water may enter the system via the upper sealing edge 28 of exhaust valve 26.

Figure 3:
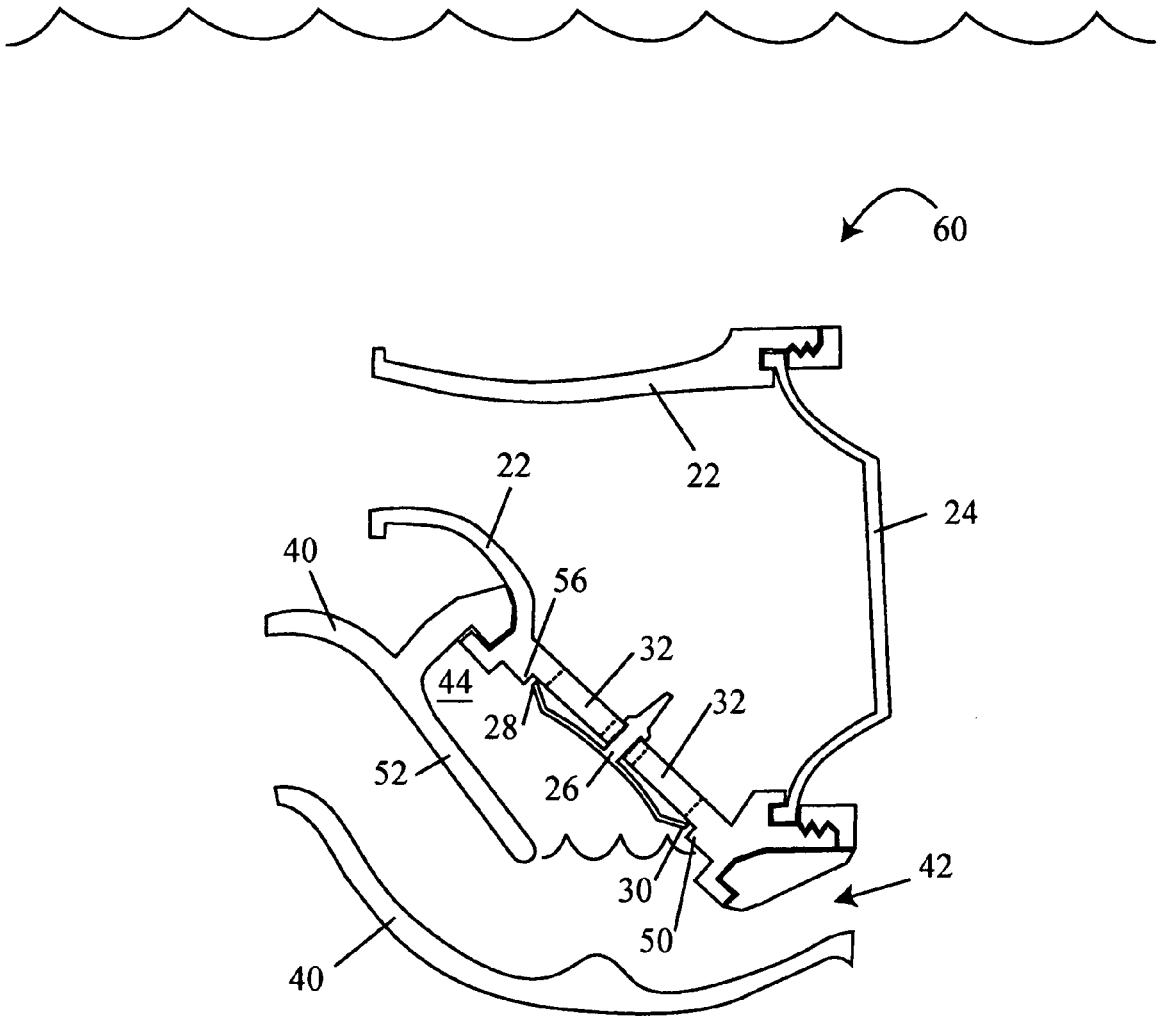
FIG. 3 is a plan view of an air exhaust system according to another exemplary embodiment, shown in the face forward position.

FIG. 3 shows another embodiment of a gas exhaust system for a SCUBA apparatus, generally at 60. System 60 may include a regulator housing 22, a diaphragm 24, as well as an exhaust valve 26. In this embodiment, exhaust valve 26 is circular and may include an upper sealing edge 28 and a lower sealing edge 30. The sealing edge is configured to allow gas to exit the system via exhaust outlets 32. Shown in this face forward position, the entire exhaust valve is operating in the gas pocket. This may reduce the pressure on the outside of the valve and make it easier to open and/or operate The system 60 may also include a bubble deflector 40. Bubble deflector 40 may include a hood 52 which may allow a gas pocket 44 to form adjacent to the exterior of exhaust valve 26. This gas pocket may allow for less resistance to operate the exhaust valve because it is in a gas pocket instead of having water against it, and may equalize the pressure between the interior and exterior of the exhaust valve such that a free flow condition of gas exiting the system may be less likely to occur. As more gas exits the system the gas will be forced out around hood 52 such that it will exit the system. Furthermore, bubble deflector 40 may be configured to exhaust the gas bubbles away from the mask and/or visual area of the user. The flow of water allowed to enter via the water inlet hole 42 allows a laminar flow of water across the exhaust valve, preventing a siphoning effect or free flow condition.

System 60 may again include projections 50, 56 to further direct the water about exhaust valve 26 such that the water may be less likely to enter the system via exhaust valve 26 either through upper sealing edge 28 or lower sealing edge 30 of the circular valve projection and seat. Projections 50, 56 may create an exhaust valve sealing edge protector such that water may not directly flow toward the edge of the circular rubber valve in a manner that would allow water to enter the system via the sealing edges.

Figure 4:
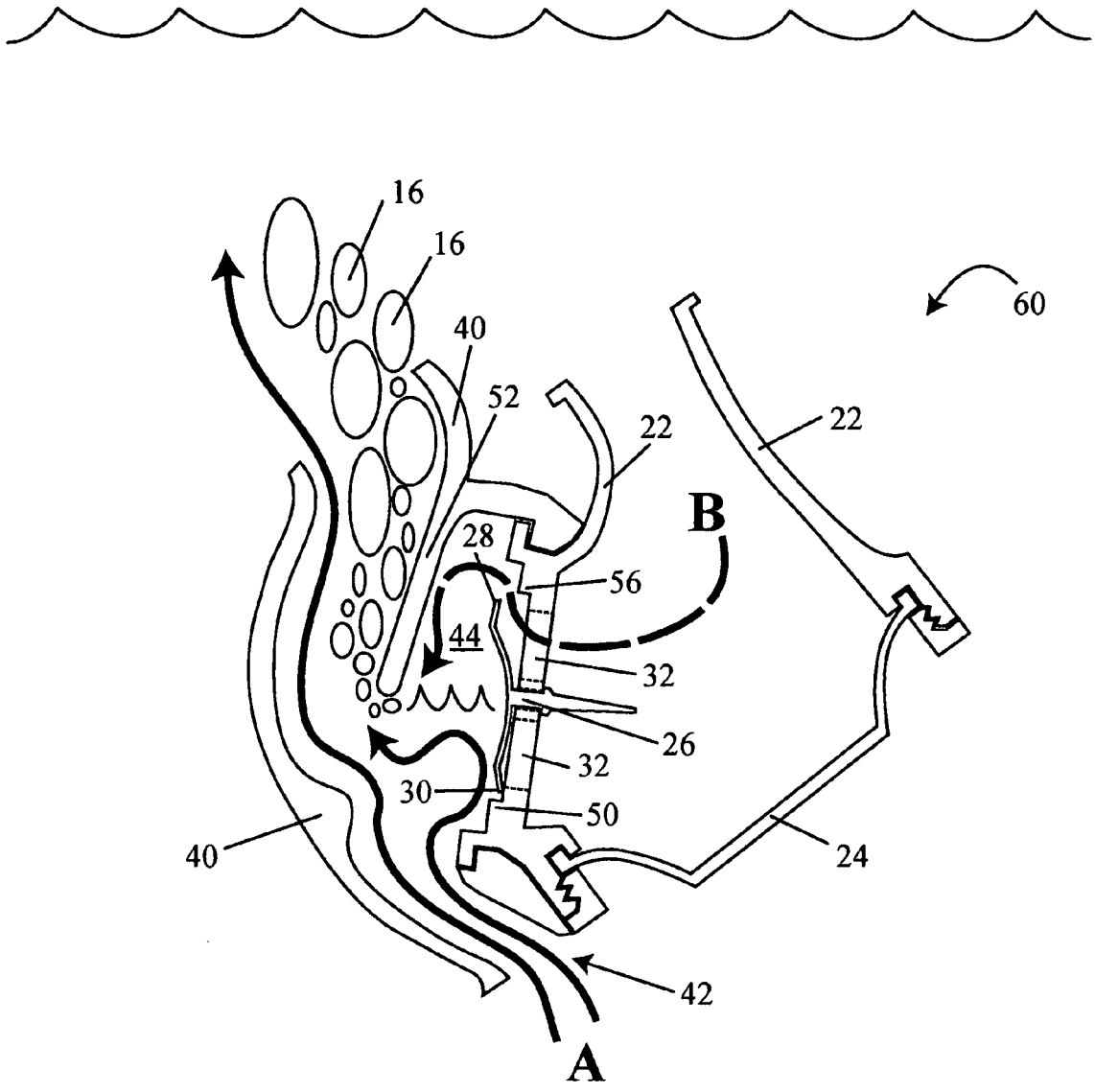
FIG. 4 is a plan view of the air exhaust system of the embodiment of FIG. 3, showing the flow of water and air about the system, shown in the face down position.

FIG. 4 shows a different orientation of exhaust gas system 60. Again system 60 includes a regulator housing 22 and a diaphragm 24, as well as an exhaust valve 26. Furthermore, system 60 again includes a bubble deflector 40 which may include a hood 52 which will allow a pocket 44 to be created by the gas exiting the system as shown by the directional arrow B. The pressure created by the exiting gas may force open top sealing edge 28 of exhaust valve 26 as it exits the system through exhaust outlet 32.

Shown in another common position, looking somewhat downwardly, the top half of the exhaust valve still is able to operate in the gas pocket lowering the resistance. In this manner hood 52 may allow an exiting gas pocket 44 to form that may equalize the pressure about the upper sealing edge 28 of exhaust valve 26. This configuration may make it less likely that a free flow condition of gas exiting the system may occur. Furthermore, this configuration directs water about exhaust valve 26 such that water may be less likely to enter the system, and that a free flow condition of gas exiting the system may be less likely to occur. A possible water flow is show by directional arrow A.

As the gas exits the system, shown by the directional arrow labeled B, it builds up in pocket 44, it will exit the system as bubbles 16 via the bubble deflector 40. With this configuration water may be less likely to enter the system via exhaust valve 26. Furthermore, this configuration may lower the exhaust resistance to operate the exhaust valve, and reduce the likelihood of a free flow of gas exiting the system, which may be caused by a siphoning effect of the water about the exterior of gas exhaust valve 26.

Figure 5:
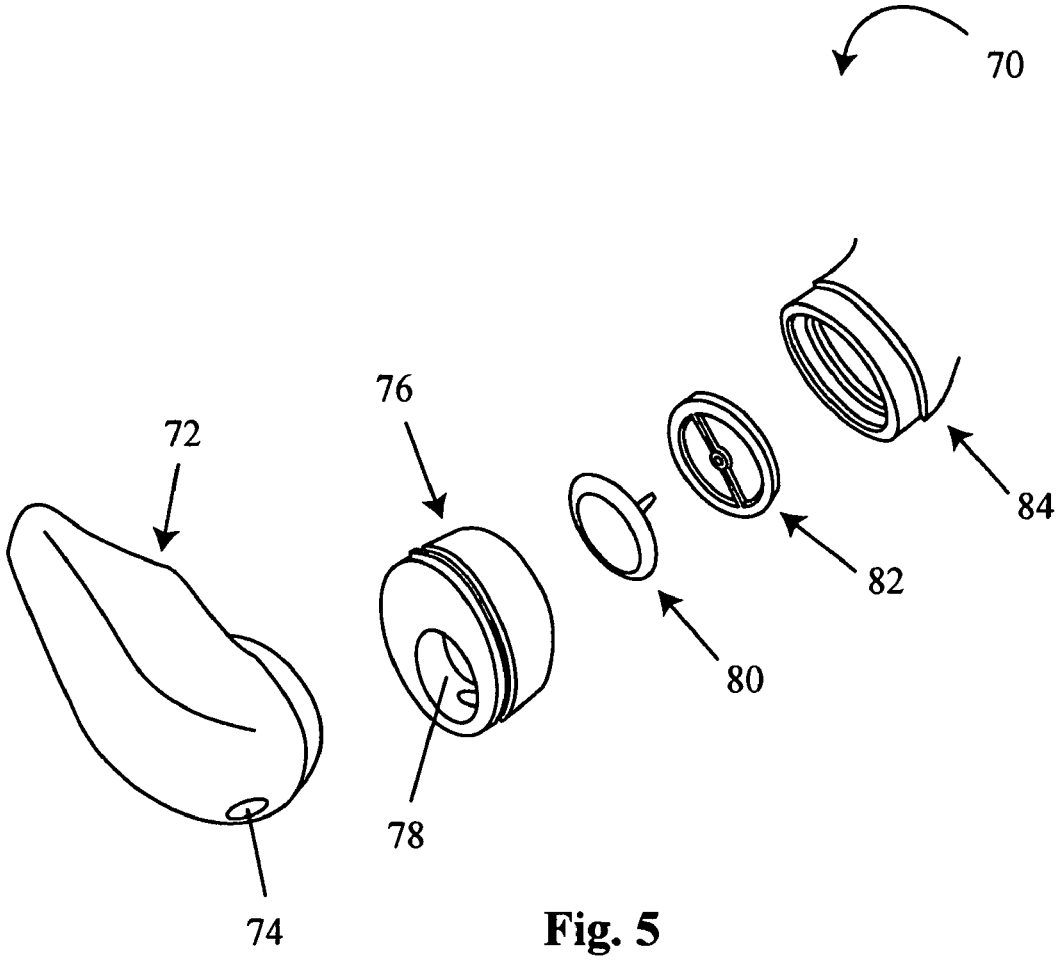
FIG. 5 is an exploded view of an air exhaust system according to another exemplary embodiment.

FIG. 5 shows a perspective view of an exemplary embodiment of a gas exhaust system 70 for a SCUBA apparatus. System 70 may include a bubble deflector 72, which may include a water inlet 74, which may allow water to enter the bubble deflector 72 to allow the system to function properly. Bubble deflector 72 may include a hood (not shown) as in the prior embodiment, such that a gas pocket may be formed to facilitate the advantage described above. System 70 may also include a valve cover 76 which in turn may include an exhaust gas exit opening 78. In this embodiment, system 70 may also include a circular rubber exhaust valve 80, which may couple to an exhaust valve seat 82, which may facilitate the mounting and coupling of the system to the regulator 84. This may be one embodiment of systems described herein, showing the location and orientation of an exhaust gas exit opening 78 and a water inlet 74 as in a space relation with the rest of the components of the system.

Figure 6:
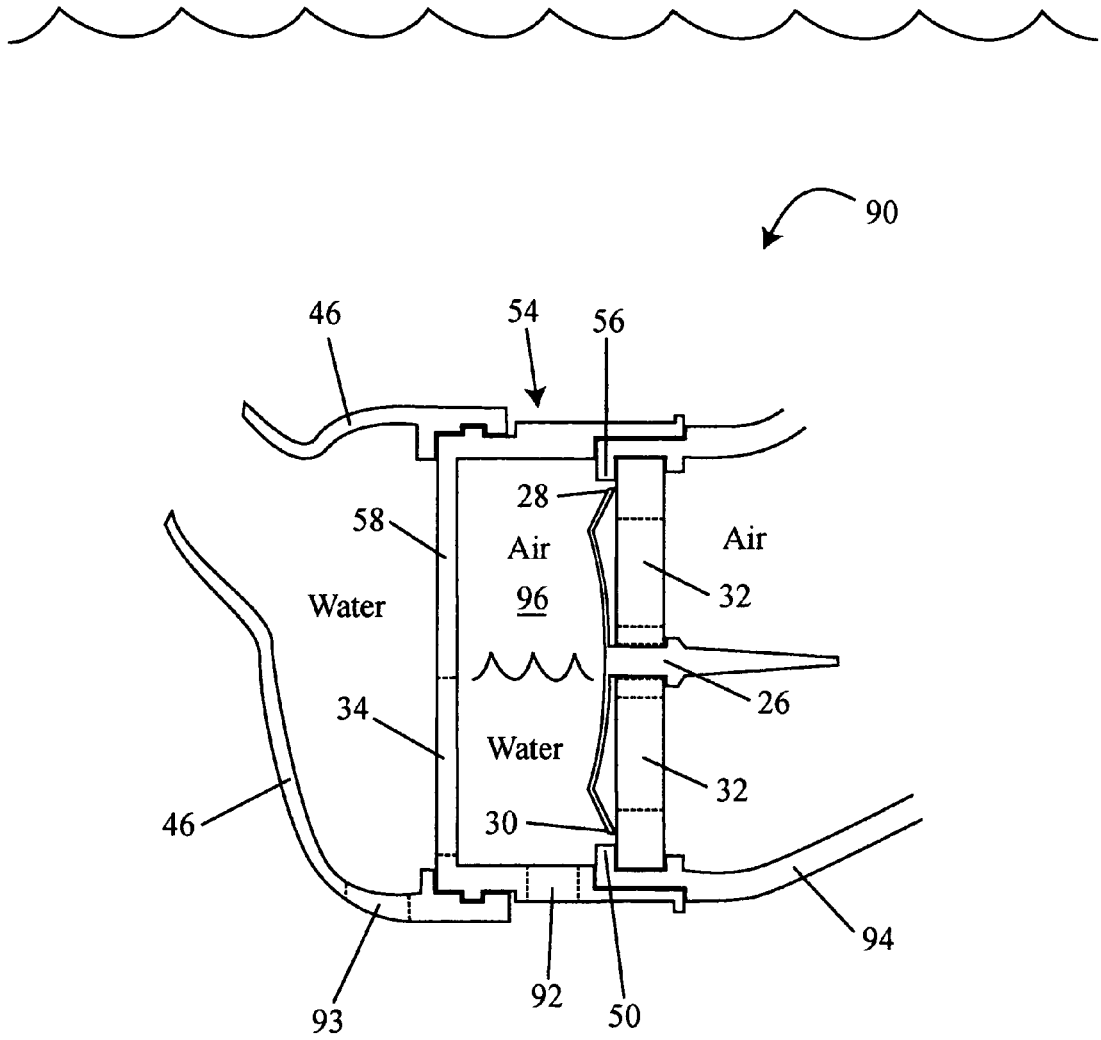
FIG. 6 is a plan view of an air exhaust system according to another exemplary embodiment.

FIG. 6 shows another embodiment of an exhaust system for a SCUBA apparatus, generally at 90. System 90 may include a regulator housing 94, an exhaust valve 26, and an exhaust outlet 32. Again, in this embodiment, a circular exhaust valve 26 may include an upper sealing edge 28 and a lower sealing edge 30. System 90 may include a valve cover 54 which may include a water inlets 92 and 93 to allow water to enter the valve cover 54. As gas exits the system, flow of water from the water inlets 92 and 93 may create a pocket 96 that again may reduce the likelihood of a free flow condition of gas exiting the system, as well as may redirect the flow of water about the exterior of exhaust valve 26. The redirection of water may also reduce the likelihood that water will enter the system via the sealing edges of exhaust valve 26, and reduce the likelihood of gas free flowing from the system.

System 90 may include a bubble deflector 46, which may facilitate gas exiting the system. Again this embodiment may include a configuration that may allow a gas pocket to form to achieve the objectives outlined above. Exhaust may exit the system via exhaust gas exit opening 34 and out through bubble deflector 46. System 90 may also include the circular projection shown at 50 and 56 that may again decrease the likelihood that water may enter the system via lower sealing edge 30 and upper sealing edge 28 of a circular exhaust valve 26, respectively.

Figure 7:
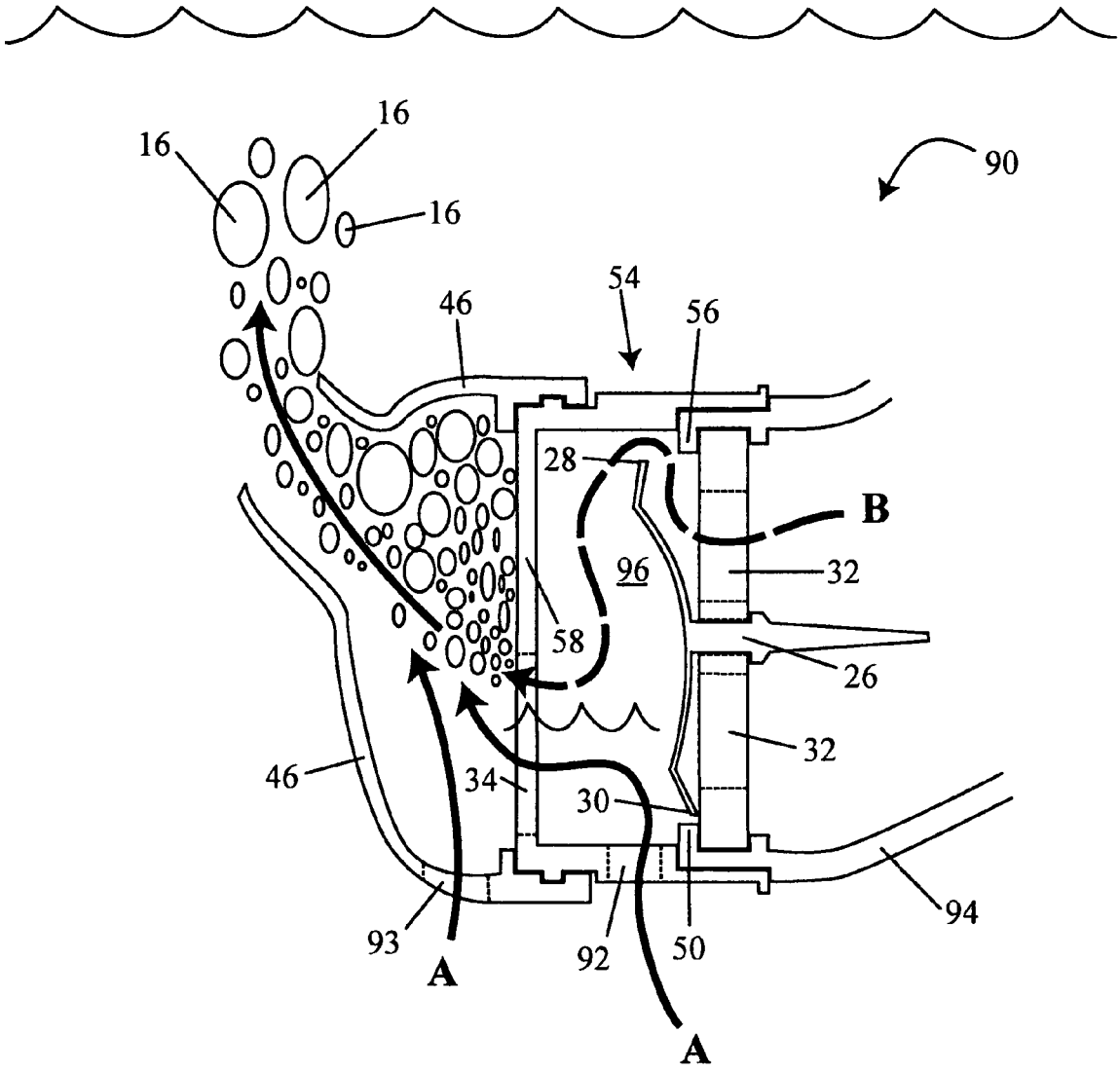
FIG. 7 is a plan view of the air exhaust system of the embodiment of FIG. 6, showing the flow of water and air about the system.

FIG. 7 shows the gas and water flow in the system 90 shown in FIG. 6. Gas may exit the system as shown by the directional arrow labeled B to form pocket 96. Gas may build up in pocket 96 due to the configuration of hood 58 and may then exit the valve cover 54 via exhaust gas opening 34.

This configuration may alter the flow of water a bout the system as shown by directional arrow A. Water may flow in water inlets 92 and 93, then may encounter exhaust gas pocket 96 and then exit the system via exhaust gas exit opening 34, and may carry bubbles 16 out of the system through the bubble deflector 46. Again this configuration may equalize the pressure between the interior and exterior of the exhaust gas system. Furthermore, it may make it less likely that water may enter the system via the exhaust valve 26 and further may decrease the likelihood of a siphoning effect occurring by directing the water flow across the water valve 26. This configuration may also make it less likely that a free flow of gas may occur of gas exiting the system.

Figure 8:
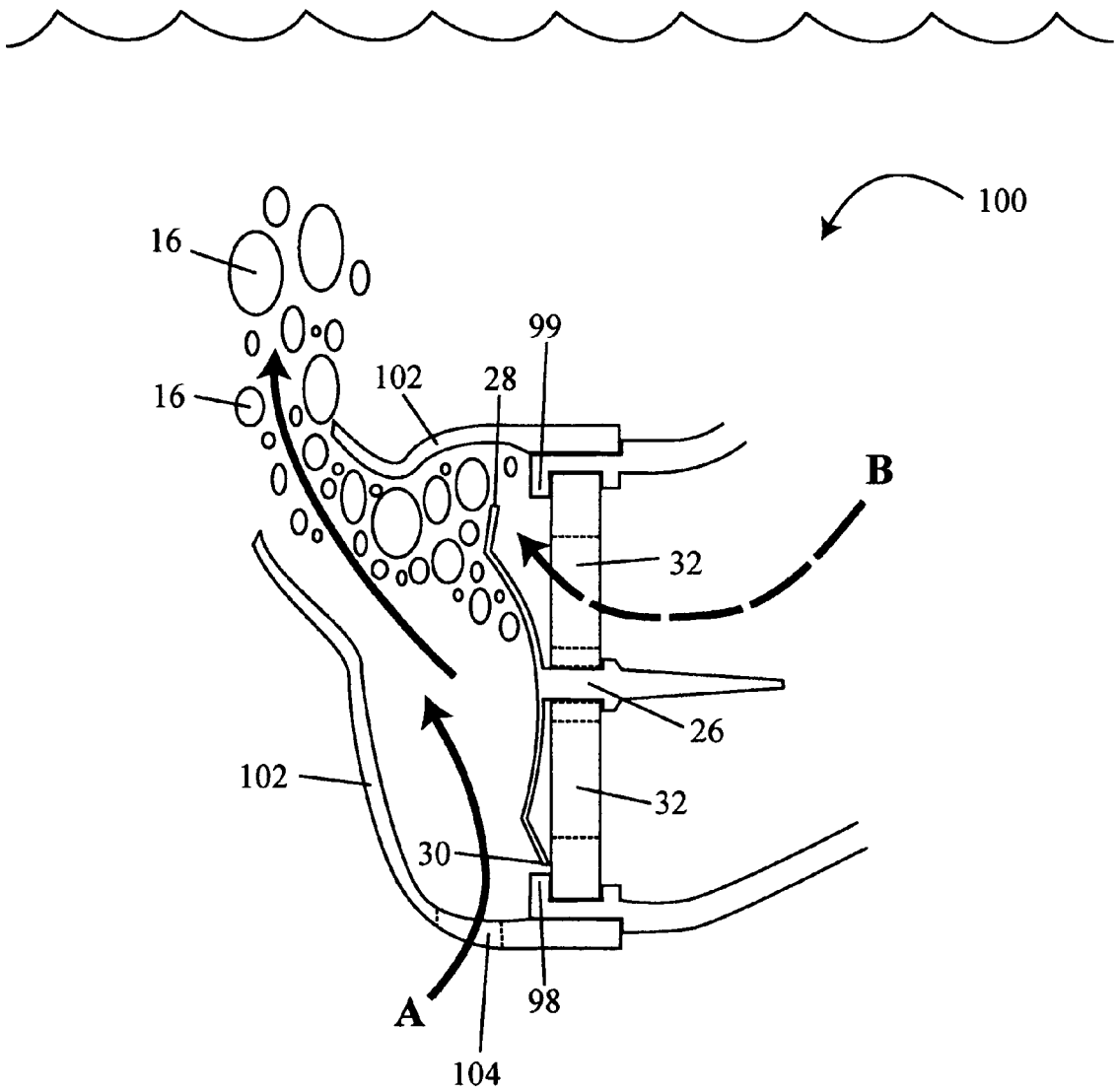
FIG. 8 is a plan view of an air exhaust system according to another exemplary embodiment.

FIG. 8 may show another embodiment of an exhaust gas system for a SCUBA apparatus generally at 100. In this embodiment, system 100 may include a circular, rubber exhaust valve 26 and an exhaust outlet 32. Again, the exhaust valve 26 may include an upper sealing edge 28 and a lower sealing edge 30. System 100 may include a circular projection 98 that may alter the flow of water about the exterior of exhaust valve 26, such that water may be less likely to enter the system via lower sealing edge 30. Water may enter the system via water inlet 104. System 100 may include circular projection 99 that may alter the water flow about the exhaust valve 26 such that water will be less likely to enter the system via upper sealing edge 28. It will be appreciated that other configurations may be utilized, such that projections are included to alter the flow of water about the exterior of the exhaust valve 26. Again, gas may exit the system as shown by the directional arrows labeled B, and may combine with the water entering the inlet hole 104 to the laminar flow of water on the exhaust valve.

This may alter the flow of water as shown by directional arrow A with respect to exhaust valve 26, such that a siphoning effect may be less likely to occur, and a free flow of gas exiting the system may be less likely to occur. Gas may then exit the system as bubbles 16 via bubble deflector 102. It will be appreciated that many configurations of bubble deflector 102 may be utilized such that it may create an air pocket to equalize the pressure and/or redirect the flow of water about exhaust valve 26 to achieve that desired results.

The means of directing water about exhaust valve 26 may include projections, hoods, and valve covers disclosed herein. Furthermore, the means of directing water may also include all other configurations and embodiments disclosed in this specification.

The means of creating a pocket adjacent the exhaust valve may include the hoods and valve covers described and shown, herein. Furthermore, means of creating a pocket adjacent the exhaust valve may include all other configurations disclosed herein.

The bubble deflector may be made of hard rubber, plastic, or other materials. Exhaust valve 26 may be made from rubber, metal, hard plastic, or other material. Other portions of the system may be made from injection-molded rubber, plastics, metals and other materials and combinations thereof, as desired.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawing and description are illustrative and not meant to be a limitation thereof.

What is claimed is:

1. An underwater exhaust system, comprising:

an air regulator housing;

at least one exhaust valve operatively coupled to said air regulator housing, said at least one exhaust valve having a water interface side with a lower sealing edge and an upper sealing edge;

at least one bubble deflector coupled to said air regulator housing and defining an air pocket space communicating with said water interface side of said at least one exhaust valve; and at least one water inlet passage being formed in said at least one bubble deflector below said lower sealing edge of said at least one exhaust valve to prevent free flow of fluid within the air regulator.

2. The underwater exhaust system of claim 1, wherein exhaust valve at said air pocket space remains unobstructed, whereby the exhaust resistance on said water interface side of said at least one exhaust valve is minimized.

3. An underwater exhaust system of claim 1, comprising:

a housing for an air regulator;

at least one exhaust valve operatively coupled to said air regulator housing, said at least one exhaust valve having a water interface side with a lower sealing edge and an upper sealing edge;

at least one bubble deflector coupled to said air regulator housing and adapted to create an air space on said water interface side of said at least one exhaust valve; and at least one water inlet passage being formed in said at least one bubble deflector below said lower sealing edge of said at least one exhaust valve to prevent free flow of fluid within the air regulator;

wherein said air regulator housing is provided with a stepped seating area for said water interface side of said at least one exhaust valve.

4. The underwater exhaust system of claim 3, wherein said stepped seating area surrounds said upper and lower sealing edges of said at least one exhaust valve to block the entry therebeneath of water flowing past said water interface side of said at least one exhaust valve.

5. The underwater exhaust system of claim 4, wherein said stepped seating area helps prevent leakage of said at least one exhaust valve.

6. The underwater exhaust system of claim 1, wherein said at least one exhaust valve is provided with a sealing edge protector ring, said air regulator housing being adapted to accommodate said sealing edge protector ring.

7. The underwater exhaust system of claim 6, wherein said sealing edge protector ring helps prevent leakage of said at least one exhaust valve.

8. An underwater exhaust system of, comprising:

a housing for an air regulator;

at least one exhaust valve operatively coupled to said air regulator housing, said at least one exhaust valve having a water interface side with a lower sealing edge and an upper sealing edge;

at least one bubble deflector coupled to said air regulator housing and adapted to create an air space on said water interface side of said at least one exhaust valve; and at least one water inlet passage being formed in said at least one bubble deflector below said lower sealing edge of said at least one exhaust valve to prevent free flow of fluid within the air regulator;

wherein said air pocket is adapted to lower the exhaust resistance on said water interface side of said at least one exhaust valve;

wherein said air pocket is being created by an integral hood on said at least one bubble deflector.

9. The underwater exhaust system of claim 8, wherein said integral hood is provided at one end with a lip portion.

10. The underwater exhaust system of claim 9, wherein said at least one water inlet passage is operatively disposed at a lower level relative to said lip portion.

11. The underwater exhaust system of claim 10, wherein exhaust gases from said at least one exhaust valve combine with water flowing through said at least one water inlet passage to generate a laminar flow of water on said water interface side of said at least one exhaust valve.

12. The underwater exhaust system of claim 10, wherein exhaust gases from said at least one exhaust valve and water flow through said at least one water inlet passage when the air regulator is in an upside down position.

13. The underwater exhaust system of claim 12, wherein said exhaust gas and water flow keeps the exhaust resistance at a minimum when the air regulator is in the upside down position.

14. The underwater exhaust system of claim 10, wherein exhaust gases from said at least one exhaust valve and water flow through said at least one water inlet passage when the air regulator is in a "face up" position.

15. The underwater exhaust system of claim 14, wherein said exhaust gas and water flow keeps the exhaust resistance at a minimum when the air regulator is in the "face up" position.

16. An underwater exhaust system, comprising:

a housing for an air regulator;

at least one exhaust valve operatively coupled to said air regulator housing said at least one exhaust valve having a water interface side with a lower sealing edge and an upper sealing edge;

at least one bubble deflector coupled to said air regulator housing and adapted to create an air space on said water interface side of said at least one exhaust valve; and at least one water inlet passage being formed in said at least one bubble deflector below said lower sealing edge of said at least one exhaust valve to prevent free flow of fluid within the air regulator;

wherein said air pocket is adapted to lower the exhaust resistance on said water interface side of said at least one exhaust valve;

wherein the exhaust resistance is being lowered when the air regulator is in a "face forward" position.

17. An underwater exhaust system, comprising:

a housing for an air regulator;

at least one exhaust valve operatively coupled to said air regulator housing, said at least one exhaust valve having a water interface side with a lower sealing edge and an upper sealing edge;

at least one bubble deflector coupled to said air regulator housing and adapted to create an air space on said water interface side of said at least one exhaust valve; and at least one water inlet passage being formed in said at least one bubble deflector below said lower sealing edge of said at least one exhaust valve to prevent free flow of fluid within the air regulator;

wherein said air pocket is adapted to lower the exhaust resistance on said water interface side of said at least one exhaust valve;

wherein the exhaust resistance is being lowered when the air regulator is in a "face down" position.

* * * * *